US010444668B2

(12) United States Patent
Kitajima et al.

(10) Patent No.: US 10,444,668 B2
(45) Date of Patent: Oct. 15, 2019

(54) DEVELOPING APPARATUS AND IMAGE FORMING APPARATUS

(71) Applicant: CANON KABUSHIKI KAISHA, Tokyo (JP)

(72) Inventors: Tomoharu Kitajima, Toride (JP); Yushi Sadamitsu, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/865,126

(22) Filed: Sep. 25, 2015

(65) Prior Publication Data

US 2016/0091823 A1 Mar. 31, 2016

(30) Foreign Application Priority Data

Sep. 25, 2014 (JP) ..... 2014-194938
Jul. 6, 2015 (JP) ..... 2015-135315

(51) Int. Cl.
*G03G 15/08* (2006.01)

(52) U.S. Cl.
CPC ..... *G03G 15/0877* (2013.01); *G03G 15/0893* (2013.01)

(58) Field of Classification Search
CPC ..... G03G 15/0877; G03G 15/0886
(Continued)

(56) References Cited

U.S. PATENT DOCUMENTS 6,978,106 B2 * 12/2005 Masuda ..... G03G 15/0872 399/256
8,818,245 B2 8/2014 Takaya et al.
(Continued)

FOREIGN PATENT DOCUMENTS

JP H02-021591 B2 5/1990
JP 2003-015418 A 1/2003
(Continued)

OTHER PUBLICATIONS

English machine translation of Masuda (JP 2003-015418 A); "Developing Device, Developing Cartridge and Process Cartridge"; by Masuda, Tsuneji; published Jan. 17, 2013.*
(Continued)

*Primary Examiner* — David M. Gray
*Assistant Examiner* — Geoffrey T Evans
(74) *Attorney, Agent, or Firm* — Venable LLP

(57) ABSTRACT

A developing device is usable with a first image forming apparatus and a second image forming apparatus which include respective image bearing members movable at different rotational speeds during an image forming operation, and includes a rotatable developer bearing member that develops an electrostatic latent image formed on the image bearing member, a developer container that accommodates a developer, and a feeding member to feed the developer in the developing container. In addition, a discharge opening is provided in the developer container and permits discharging of the developer from the developer container, and a covering member is movable relative to the developer container and capable of changing a lower end of the discharge opening between a first level for discharging toner and a second level for discharging toner, depending on which image forming apparatus the developing device is used with, wherein the first and second levels are different from each other.

40 Claims, 12 Drawing Sheets

(58) Field of Classification Search
USPC ..... 399/260
See application file for complete search history.

(56) References Cited

U.S. PATENT DOCUMENTS

| | | | | |
|---|---|---|---|---|
| 2004/0114966 | A1 | 6/2004 | Masuda | |
| 2005/0214001 | A1 | 9/2005 | Sakamaki | |
| 2007/0223941 | A1* | 9/2007 | Dawson | G03G 15/0875 399/12 |
| 2009/0257763 | A1* | 10/2009 | Hayashi | G03G 15/0848 399/53 |
| 2010/0028053 | A1* | 2/2010 | Kasai | G03G 15/0893 399/255 |
| 2010/0239322 | A1 | 9/2010 | Kido | |
| 2010/0322670 | A1* | 12/2010 | Ishiguro | G03G 15/0853 399/254 |
| 2011/0229209 | A1* | 9/2011 | Takaya | G03G 15/0844 399/257 |
| 2011/0236074 | A1* | 9/2011 | Maeda | G03G 15/0893 399/254 |
| 2012/0219328 | A1* | 8/2012 | Oda | G03G 15/0875 399/260 |
| 2012/0269555 | A1* | 10/2012 | Matsumoto | G03G 15/0893 399/258 |
| 2013/0216257 | A1 | 8/2013 | Fujimura et al. | |
| 2015/0016837 | A1 | 1/2015 | Kitajima | |
| 2015/0139712 | A1 | 5/2015 | Sadamitsu et al. | |

FOREIGN PATENT DOCUMENTS

| | | | | |
|---|---|---|---|---|
| JP | 2003015418 | A | * | 1/2003 |
| JP | 2004-206088 | A | | 7/2004 |
| JP | 2005-274685 | A | | 10/2005 |
| JP | 2005-283685 | A | | 10/2005 |
| JP | 2009-258166 | A | | 11/2009 |
| JP | 2010-139924 | A | | 6/2010 |
| JP | 2010-224105 | A | | 10/2010 |
| JP | 2010-256838 | A | | 11/2010 |
| JP | 2011-002756 | A | | 1/2011 |
| JP | 2011-197442 | A | | 10/2011 |
| JP | 2011-203330 | A | | 10/2011 |
| JP | 2012-027244 | A | | 2/2012 |
| JP | 2012-194545 | A | | 10/2012 |
| JP | 2012-234153 | A | | 11/2012 |
| JP | 2013-171105 | A | | 9/2013 |
| JP | 2015-191126 | A | | 11/2015 |

OTHER PUBLICATIONS

Japanese Office Action dated Feb. 26, 2019, in related Japanese Patent Application No. 2015-135315.

* cited by examiner (a)

(b)

DEVELOPING APPARATUS AND IMAGE FORMING APPARATUS

FIELD OF THE INVENTION AND RELATED ART

The present invention relates to a developing device for developing a latent image formed on an image bearing member, and an image forming apparatus equipped with a developing device. In particular, it relates to a developing device structured so that it can be used by multiple image forming apparatuses which are different in the process speed with which an image is formed.

An image forming apparatus, such as a copying machine, a printer, a facsimile machine, a multifunction machine capable of performing two or more functions of the preceding apparatuses, etc., which uses an electrophotographic image forming method or an electrophotographic recording method, develops an electrostatic latent image formed on an image bearing member such as a photosensitive drum, into a visible image by adhering developer to the electrostatic latent image. As a developing device used for a development process such as the above-described one, there has been known a developing device which uses two-component developer (which hereafter will be referred to simply as "developer"), which is made up of nonmagnetic toner and magnetic carrier.

A developing method which uses developer such as the above-described one forms an image by charging toner with the use of friction between carrier particles and toner particles, and electrostatically adhering charged toner particles to a latent image. Thus, the toner in the developing device is gradually consumed by the developing operation, whereas the carrier in the developing device is not consumed by the developing operation, and therefore, remains in the developing device. Thus, the carrier particles are contaminated across their surface by the external additives of the developer, toner particles, etc. Eventually, the carrier reduces in its ability to charge toner particles.

Therefore, there have been proposed various solutions to the above-described problem. One of them is proposed in Japanese Laid-open Patent Application H02-21591. According to this application, one of the walls of the developer circulating section of a developing device is provided with a developer outlet, through which a part of the body of developer in the developing device is discharged (made to overflow) from the developing device to discharge some of the old carrier particles in the developing device. A developing device such as the one disclosed in the abovementioned patent application is structured so that the developing device is replenished with toner by an amount proportional to the amount by which toner was consumed by development, and also, with carrier by an amount proportional to the amount by which the old developer (carrier) was made to overflow from the developing device, in order to replace the old carriers with a fresh supply of carrier to keep the carrier in the developing device stable in charging ability.

Generally speaking, the greater an image forming apparatus in print count per unit length of time, the faster it is in process speed, and also, in the speed with which it drives developing device thereof. Further, in the case of a developing device such as the above-described one, a fresh supply of developer is trickled into the developing device while the old developer (carrier) in the developing device is trickled out of the device. Thus, the amount by which developer is discharged from the developing device is proportional to the speed at which the developing device is driven (rotational speed of its developer conveying member). Therefore, it has been a common practice to equip an image forming apparatus with such a developing device that matches the image forming apparatus in terms of process speed.

In a case where each image forming apparatus is equipped with a developing device which is dedicated thereto in terms of process speed, it is reasonable to think that there have to be various types of developing devices which are the same in external appearance, but are different in process speed. Therefore, it is possible that wrong components will be installed during developing device manufacture, and/or wrong developing devices are installed during the servicing of an image forming apparatus. In order to prevent these problems, a developing device has to be manufactured so that it matches in process speed to an image forming apparatus by which it is used. This is problematic in that in order to solve the above-described problem, multiple types of developing devices which are different in process speed have to be manufactured and stocked.

On the other hand, in order to make it possible for image forming apparatuses which are different in process speed to use the same developing device, it is possible to structure a developing device so that it remains the same in developer conveyance speed regardless of its process speed. In such a case, however, the system for driving the development sleeve which bears developer and conveys the developer has to be separated from the system for driving the developer conveying member, in order to make it possible for only the development sleeve to be changed in speed according to the process speed of the image forming apparatus. Therefore, a developing device increases in manufacture cost. In addition, there occurs a technical issue that from the standpoint of supplying the development sleeve with developer, the amount of difference in speed between the development sleeve and developer conveying member has to be within a preset range.

SUMMARY OF THE INVENTION

The present invention is made in consideration of the above-described issues. Thus, the primary object of the present invention is to provide a developing device which is structured so that it is usable with multiple image forming apparatuses which are different in process speed, and yet, is substantially lower in cost than any conventional developing device usable with multiple image forming apparatuses different in process speed.

According to an aspect of the present invention, there is provided a developing device usable with a first image forming apparatus and a second image forming apparatus which have image forming process speeds different from each other, said developing device comprising a developing container configured to accommodate a developer; a feeding member configured to feed the developer in said developing container; a discharge opening provided in said developing container and configured to permit discharging of an excessive developer in said developing container produced with supply of the developer into said developing container; and a switching mechanism configured to selectively switch a condition of an opening area of said discharge opening or a level of a lower end of said discharge opening before said developing device is mounted into a main assembly of the image forming apparatus between a first condition and a second condition which is different from the first condition.

Further features of the present invention will become apparent from the following description of exemplary embodiments with reference to the attached drawings.

Figure 5:
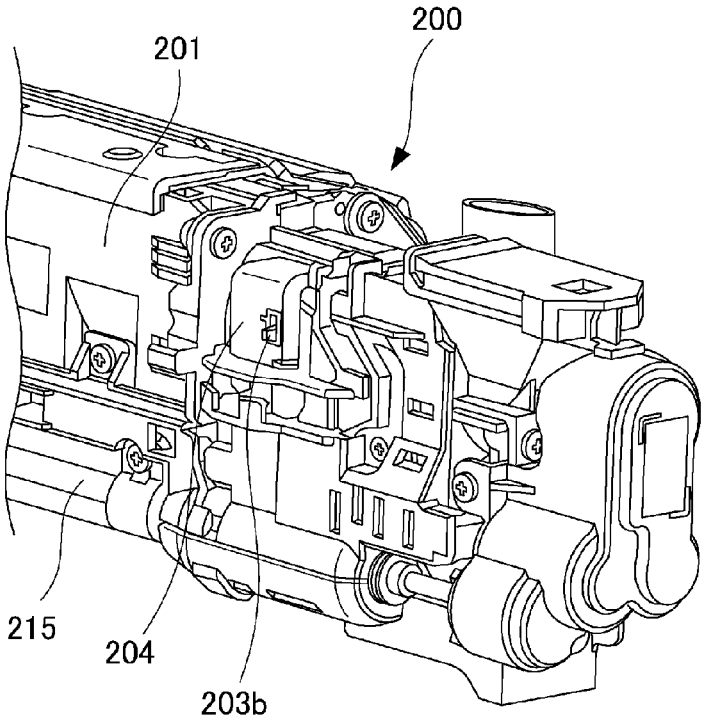
Figure 5:
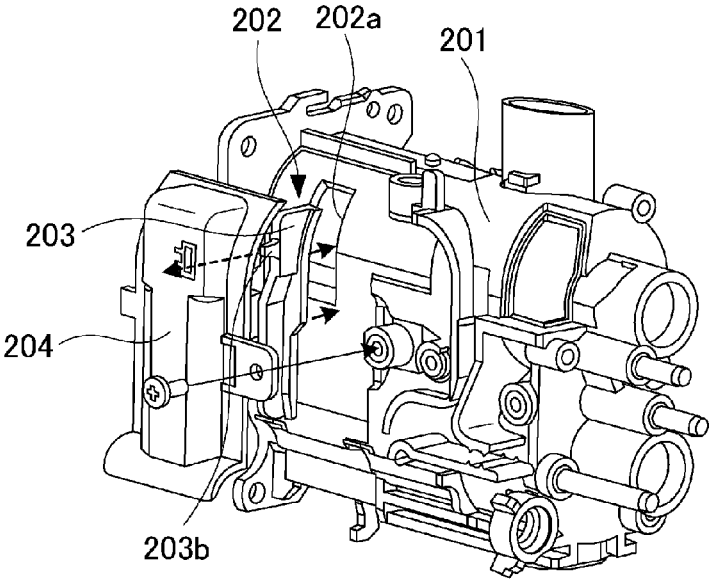

Part (a) of FIG. 5 is a perspective view of the right end portion of the developing device in the first embodiment, and part (b) of FIG. 5 is a partially exploded perspective view of the device.

Figure 6:
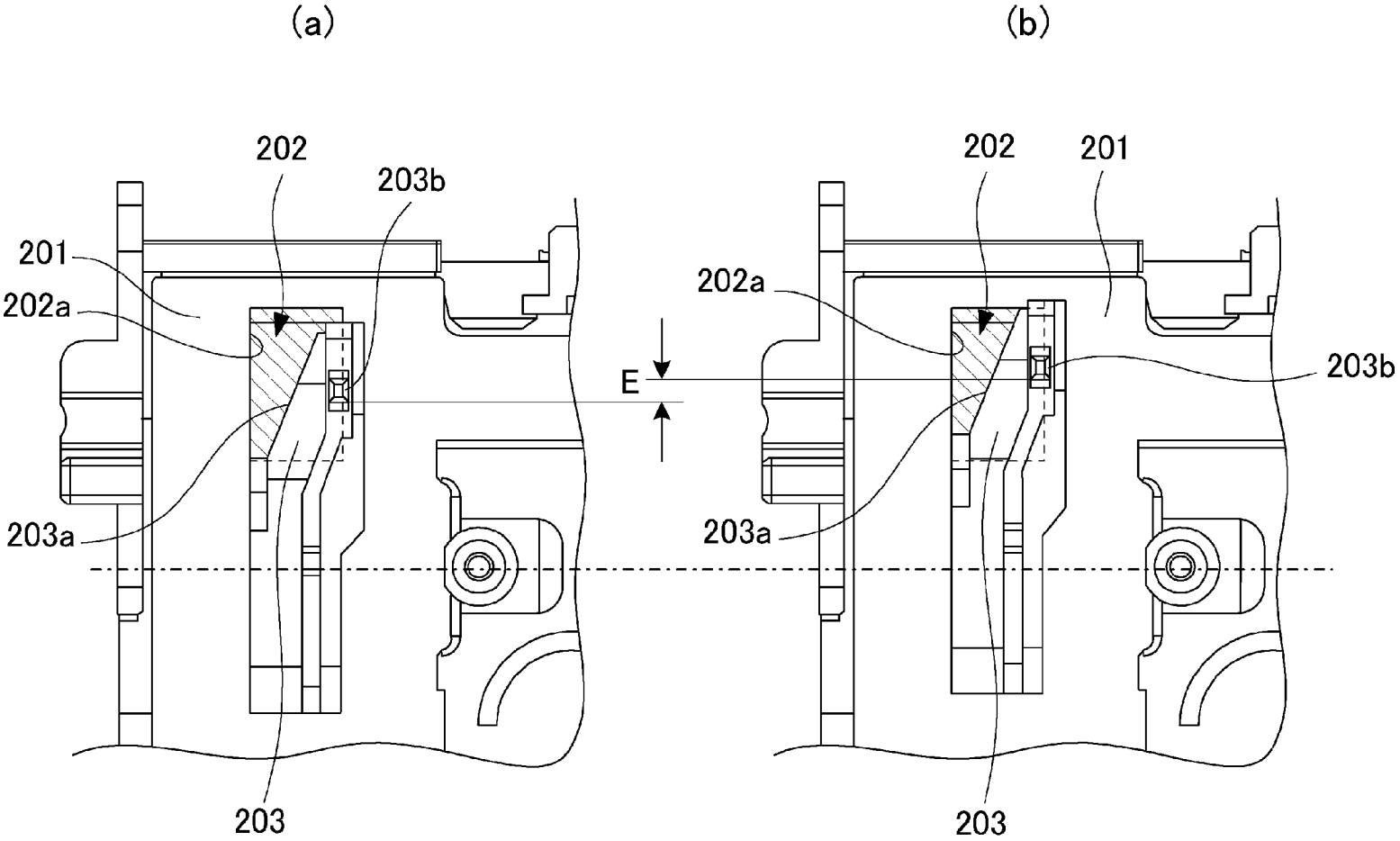

Parts (a) and (b) of FIG. 6 are plan views of the developer outlet of the developing device in the first embodiment, and shows two states of the developer outlets.

Figure 7:
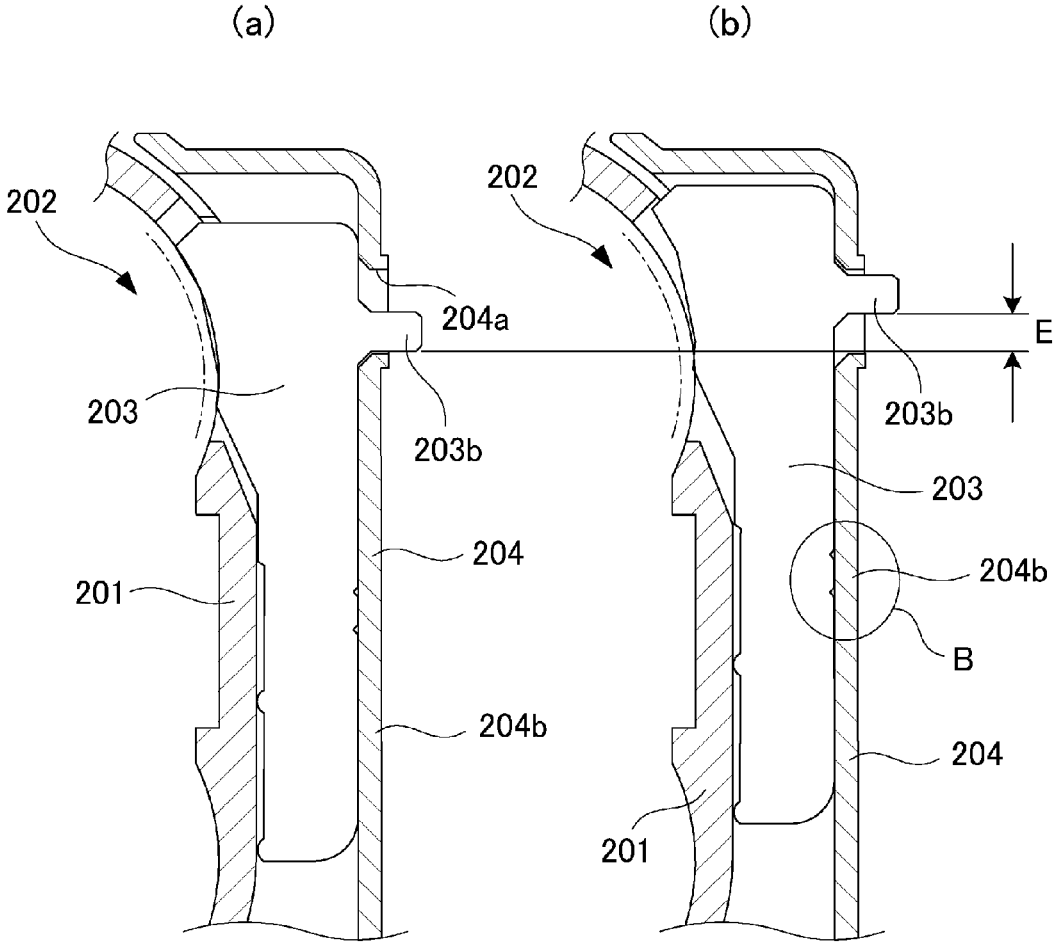

Parts (a) and (b) of FIG. 7 are sectional views of the developer outlet of the developing device in the first embodiment, and shows the two states of the device.

Figure 8:
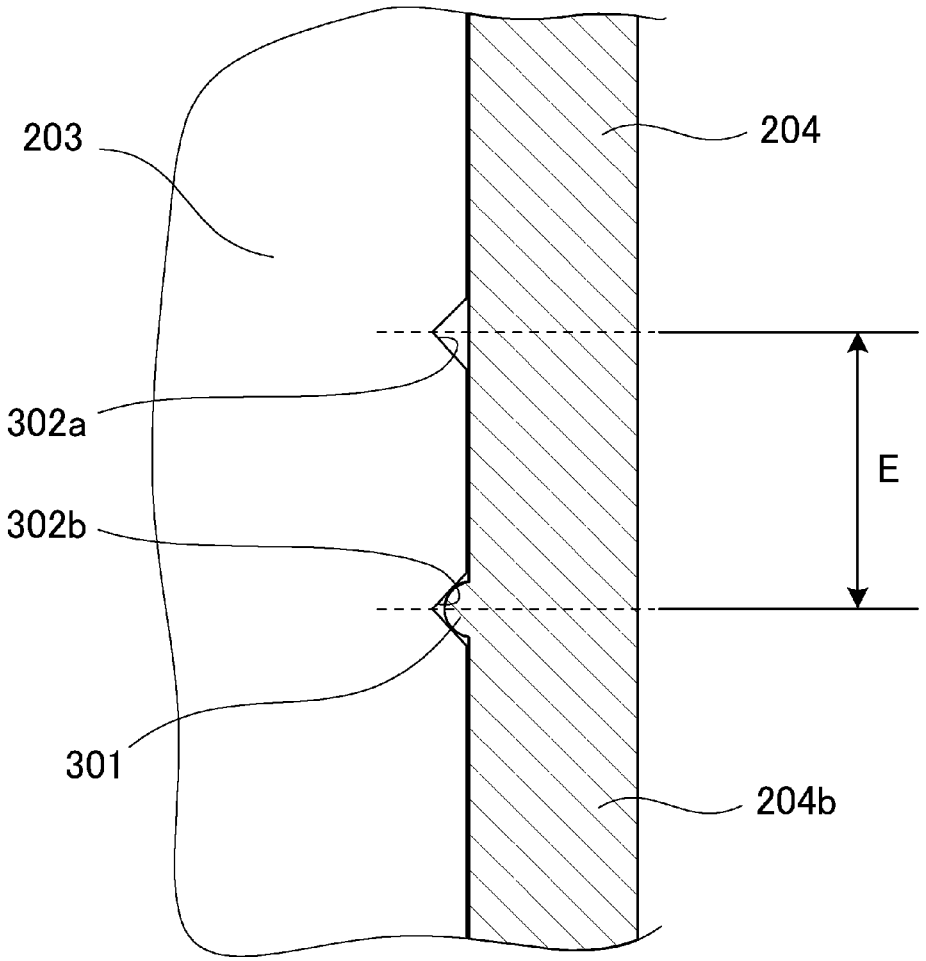

FIG. 8 is an enlarged view of the section B in FIG. 7.

Figure 9:
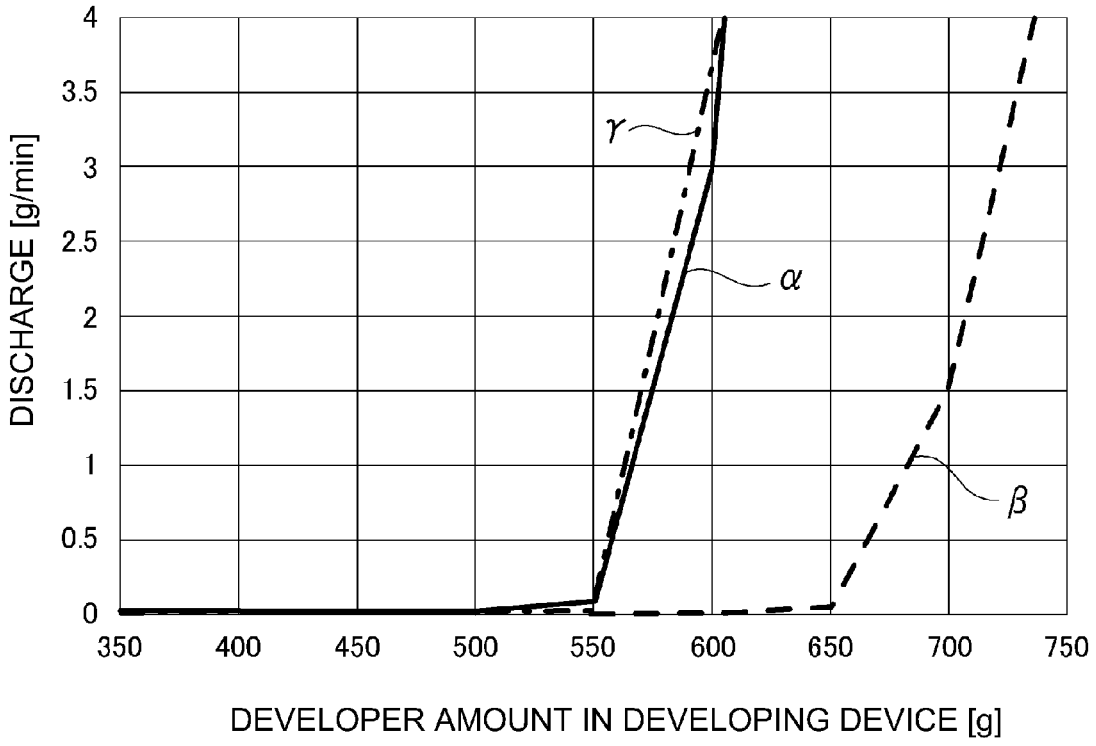

FIG. 9 is a graph which shows the changes which occur to the relationship between the amount of the developer in the developing device, and the amount by which the developer is discharged from the developing device, as the device is changed in the position of its developer outlet cover and in the developer conveyance speed.

Figure 10:
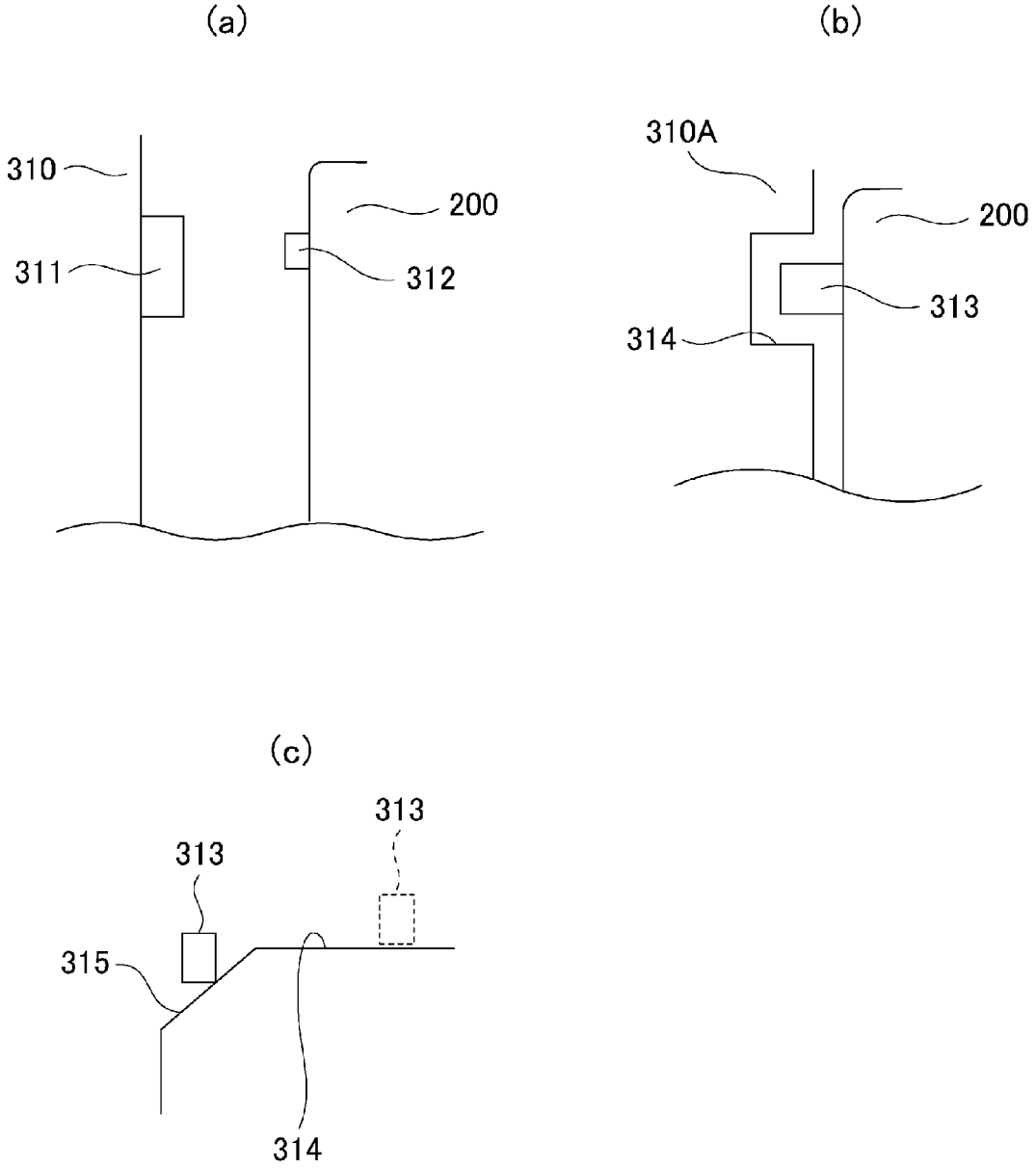

Parts (a), (b) and (c) of FIG. 10 are schematic drawings of two examples of developing device structure for preventing the errors in developing device installation, and shows the relationship between the developing device chamber in an image forming apparatus, and the developing device.

Figure 11:
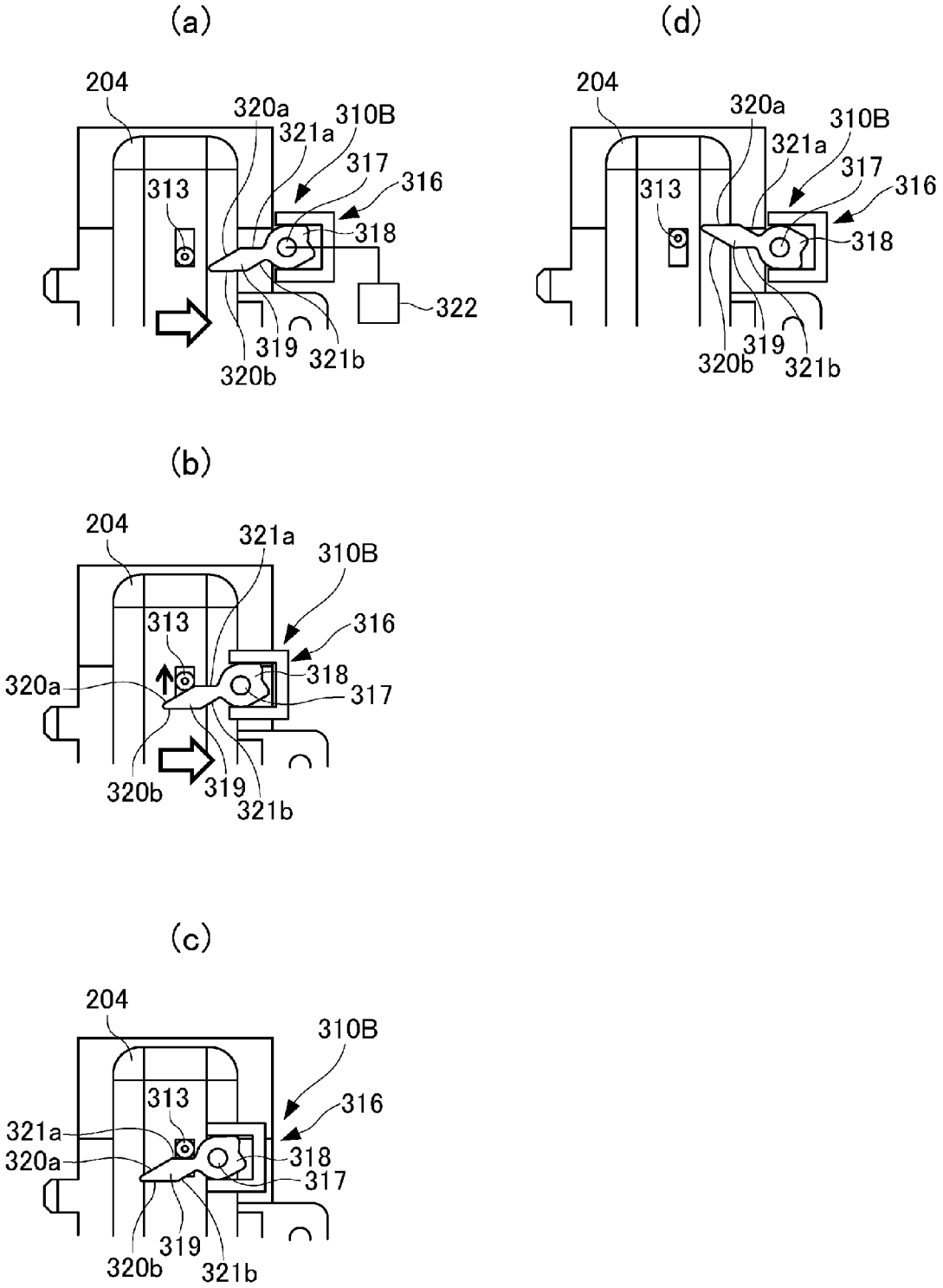

Parts (a), (b), (c) and (d) of FIG. 11 are schematic drawings of another example of structural arrangement for preventing the developing device installation errors; part (a) shows the state of the combination of the developing device and developing device chamber, in which the developing device begins to be installed into the image forming apparatus, with the knob of the developer outlet cover being in the first guiding position; part (b), the state in which the developing device is being installed; part (c) shows the state in which the developing device is after the completion of its installation; and part (d) shows the state in which the developing device begins to be installed, with the knob of the developer outlet cover being in its second guiding position.

Figure 12:
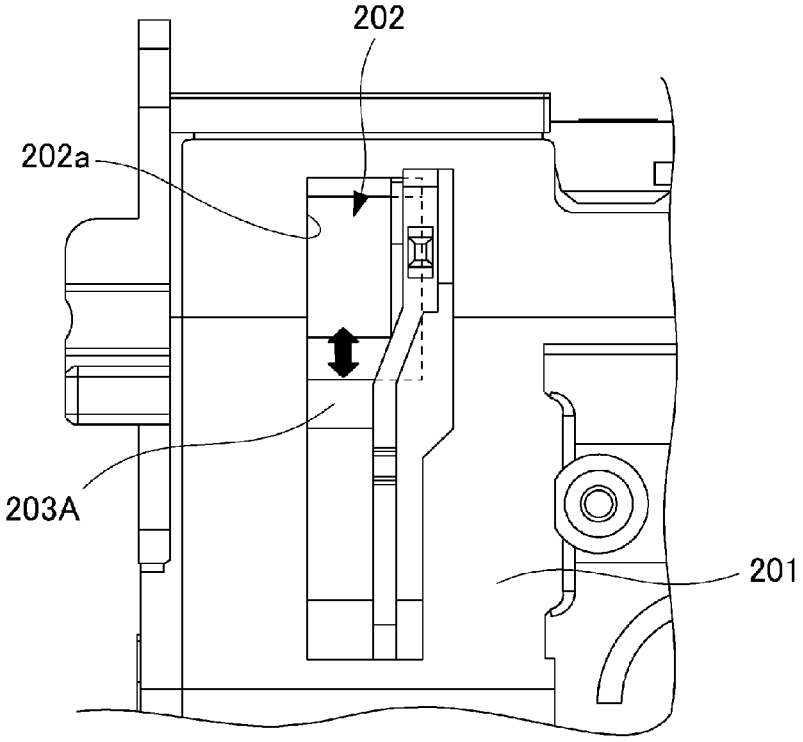

FIG. 12 is a schematic plan view of the developer outlet of the developing device in the second embodiment of the present invention, and shows the general structure of the outlet.

Figure 13:
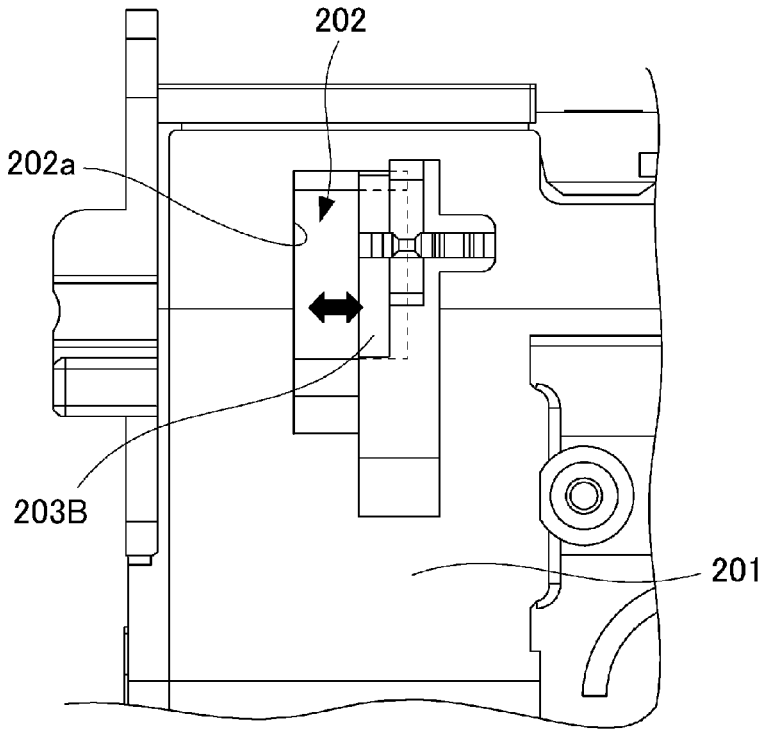

FIG. 13 is a schematic plan view of the developer outlet of the developing device in the third embodiment of the present invention, and shows the general structure of the outlet.

DESCRIPTION OF THE EMBODIMENTS

Embodiment 1

Referring to FIGS. 1-10, the first embodiment of the present invention is described. To begin with, referring to FIG. 1, the general structure of the image forming apparatus in this embodiment is described. By the way, the measurements, materials, and shapes of the structural components in the following embodiments of the present invention, and the positional relationship among the structural components, are not intended to limit the present invention in scope unless specifically noted. Further, the following embodiments are described with reference to an image forming apparatus which forms a full-color image. Needless to say, however, the embodiments are not intended to limit the present invention in terms of an image forming apparatus in which a developing in accordance with the present invention is installable.

[Image Forming Apparatus]

Figure 1:
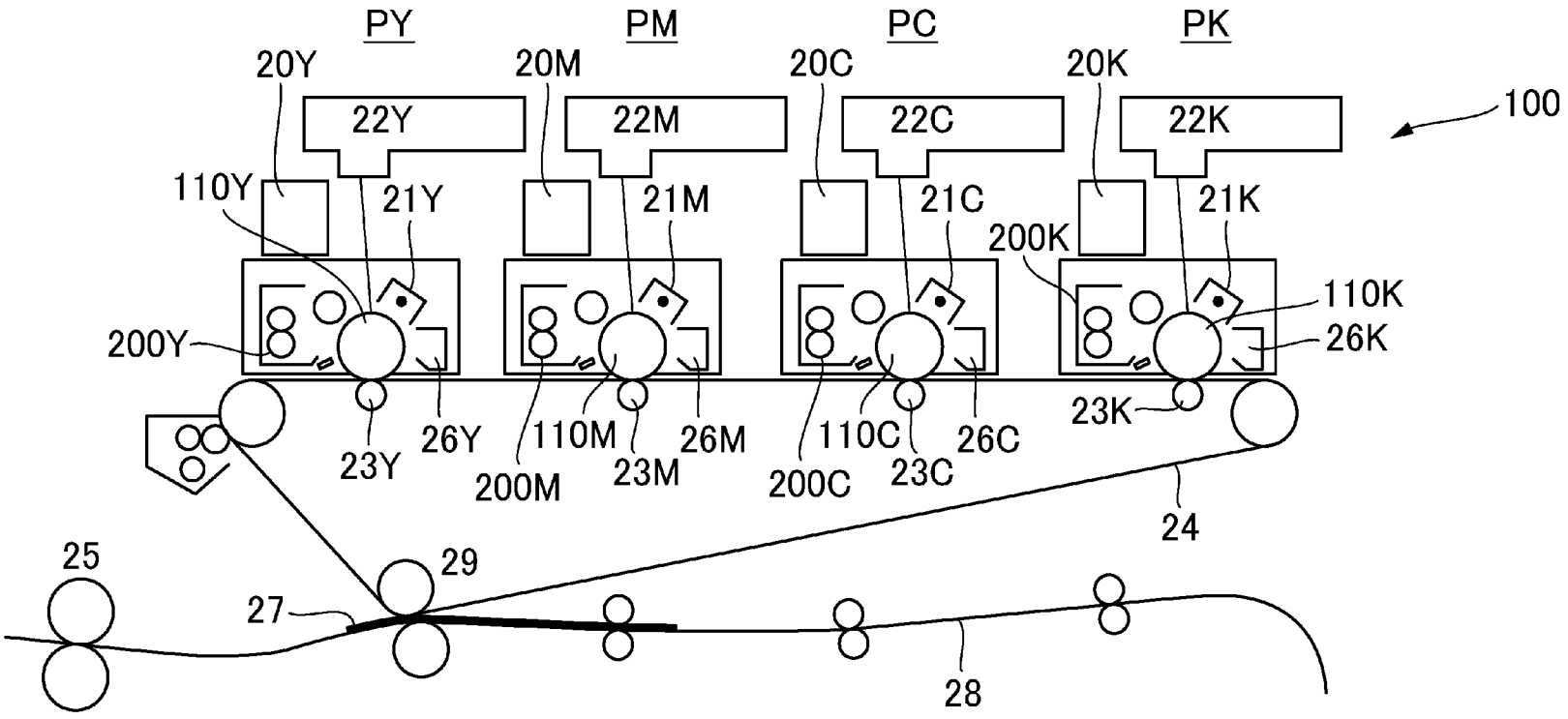
FIG. 1 is a schematic sectional view of the image forming apparatus equipped with the developing device in the first embodiment of the present invention, and shows the general structure of the apparatus.

Referring to FIG. 1, the image forming apparatus 100 in this embodiment has four image forming sections (stations) PY, PM, PC and PK which form yellow (Y), magenta (M), cyan (C) and black (K) images, respectively, and which are aligned in parallel to the rotational direction of the intermediary transfer belt 24. The four image forming sections PY, PM, PC and PK are roughly the same in structure. Thereafter, therefore, the suffixes Y, M, C and K which indicate the color of the image they form are not shown, and the four image forming sections are described together.

A photosensitive drum 110 which is an image bearing member is rotatably supported. Its peripheral surface is uniformly charged by a primary charging device 21. Then, the uniformly charged peripheral surface of the photosensitive drum 110 is exposed to a beam of light, for example, a beam of laser light, outputted by an exposing device 22 while being modulated by information signals. Consequently, an electrostatic latent image is effected on the peripheral surface of the photosensitive drum 110. Then, the electrostatic latent image is developed by a developing device 200, into a visible image (image formed of toner, which hereafter may be referred to as toner image), on the peripheral surface of the photosensitive drum 110.

Then, the visible image (toner image) is transferred onto an intermediary transfer belt 24 by a primary transfer charging device 23. During this transfer, toner images which are different in color are sequentially transferred in layers onto the intermediary transfer belt 24 and then, are conveyed to a secondary transferring section 29, in which the toner images are transferred (secondary transfer) onto a sheet 27 of recording medium, such as ordinary paper, OHP film, etc., which was conveyed to the secondary transferring section 29 through a recording medium conveyance passage 28. Then, the toner images on the sheet P of recording medium are fixed to the sheet 27 by a fixing device 25. Meanwhile the transfer residual toner, that is, the toner remaining on the peripheral surface of the photosensitive drum 110 after the transfer of the toner image from the photosensitive drum 110, is removed by a cleaning device 26. As the toner in the developing device 200 is consumed for image formation, the developing device 200 is replenished with toner, along with carrier, by a replenishment toner reservoir 20.

[Developing Device]

Figure 2:
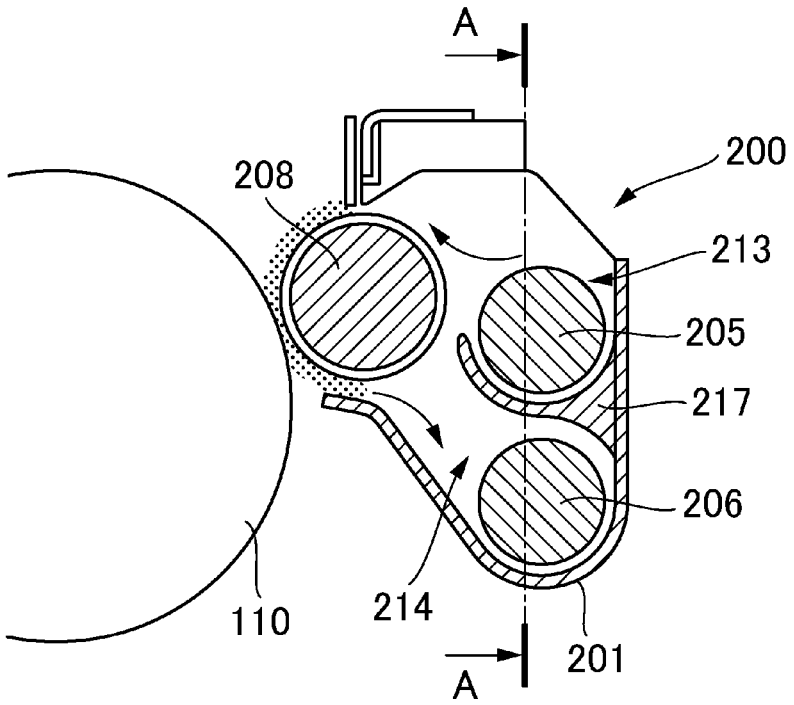
FIG. 2 is a schematic cross-sectional view of the developing device in the first embodiment, and shows the general structure of the device.
Figure 3:
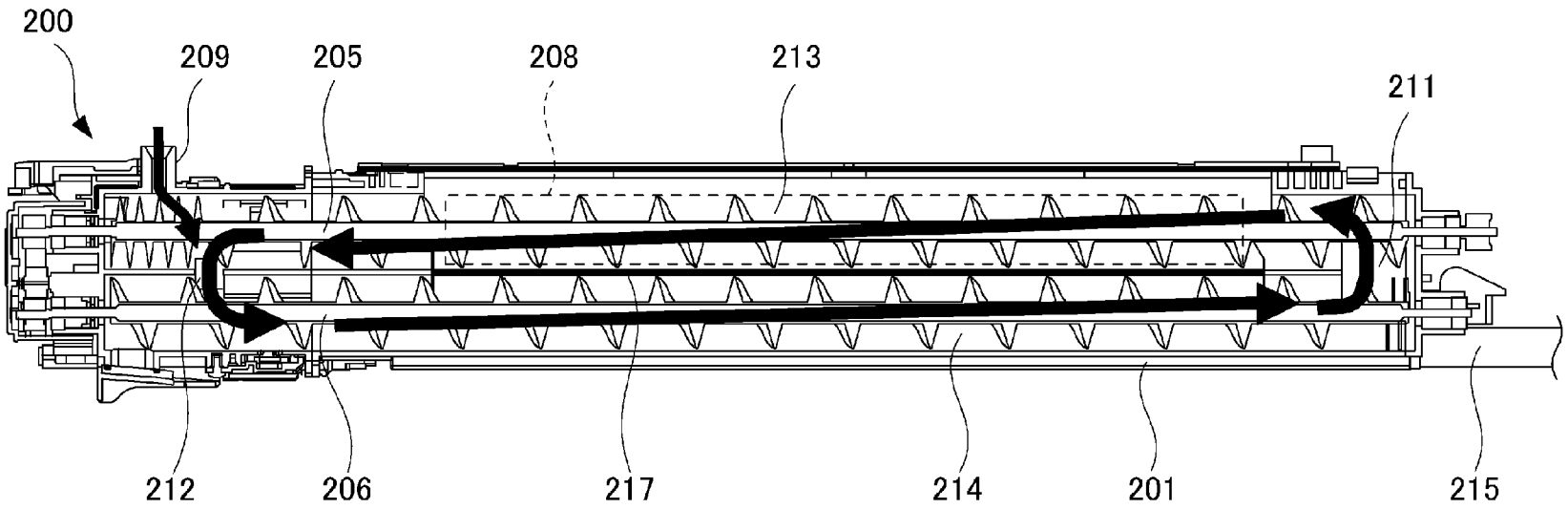
FIG. 3 is a cross-sectional view of the developing device in the first embodiment, at a plane A-A in FIG. 2.
Figure 4:
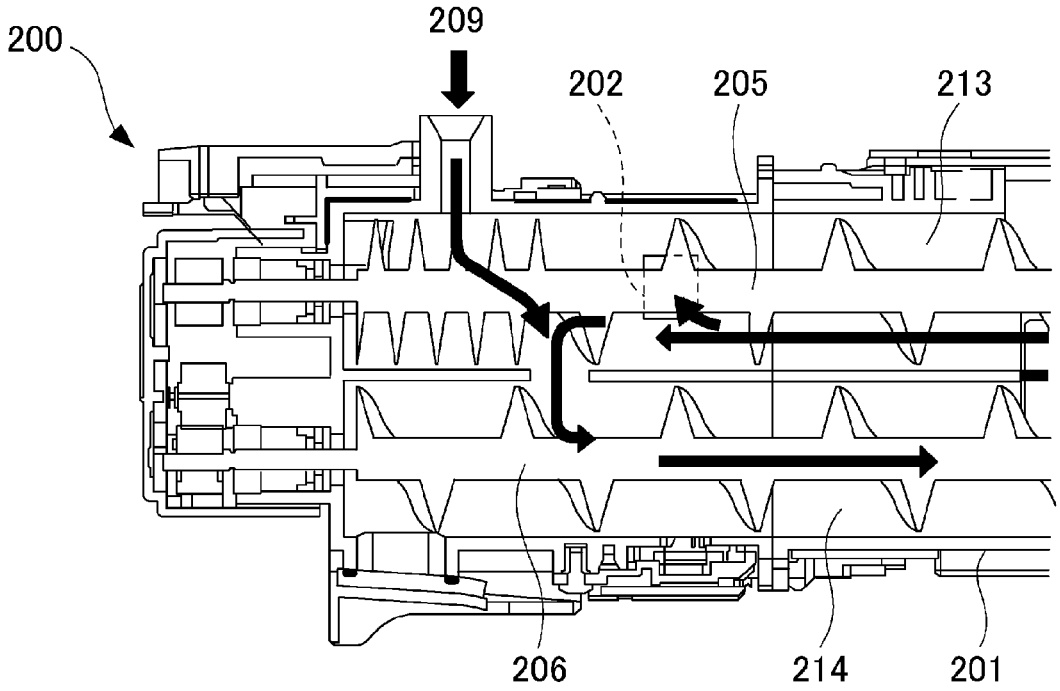
FIG. 4 is an enlarged view of the left portion of FIG. 3.

Next, referring to FIGS. 2-4, the general structure of the developing device 200 in this embodiment is described. In this embodiment, two-component developer (which hereafter will be referred simply as developer) which is made up of nonmagnetic toner particles and magnetic carrier particles is used as developer. The developing device 200 in this embodiment has two conveyance screws 205 and 206, as developer conveying members, which convey developer while stirring the developer, and a casing in which the two screws 205 and 206 are disposed. This developing device 200 is of the so-called vertical stir type. That is, it is structured so that when it is properly situated in the image forming apparatus 100, the conveyance screw 205 is above the conveyance screw 206 in terms of the gravity direction.

The developing device 200 is provided with a casing 201 in which developer is stored, and a development sleeve 208 which is disposed in the casing 201 in such a manner that it opposes the photosensitive drum 110 through an opening with which the casing 201 is provided. Further, the developing device 200 is provided with a development chamber 213 as the first chamber which is on the opposite side of the development sleeve 208 from the aforementioned opening of the casing 201, and a stirring chamber 214 as the second chamber which is separated by a partition wall 217 from the first chamber. That is, the developing device 200 is structured so that when the developing device 200 is in its development position in the image forming apparatus 100, the stirring chamber 214 is on the underside of the development chamber 213 in terms of the gravity direction. The combination of the development chamber 213 and stirring chamber 214 forms a passage through which developer is circulated.

In the development chamber 213, the first conveyance screw 205 as the first developer conveying member is disposed, and in the stirring chamber 214, the second conveyance screw 206 as the second developer conveying member is disposed. Each of the first and second conveyance screws 205 and 206 has a spiral blade, and conveys developer by being rotationally driven by a motor as a driving force source. More concretely, the first conveyance screw 205 is disposed in the bottom portion of the development chamber 213, roughly in parallel to the rotational axis of the development sleeve 208. It conveys the developer in the development chamber 213 (first chamber), in one direction (leftward in FIG. 3) which is parallel to the axial line of the development sleeve 208, by being rotationally driven, whereas the second conveyance screw 206 is disposed in the bottom portion of the stirring chamber 214, roughly in parallel to the first conveyance screw 205. It conveys the developer in the stirring chamber 214 (second chamber), in the opposite direction from the developer conveyance direction of the first conveyance screw 205, that is, the other direction (rightward in FIG. 3).

As the second conveyance screw 206 conveys the developer in the opposite direction from the developer conveyance direction of the first conveyance screw 205, to the other end (right end in FIG. 3) of the stirring chamber 214, it pushes the developer in the stirring chamber 214 up into the development chamber development chamber 213, through a passage 211 between the stirring chamber 214 and development chamber 213, whereas as the developer in the development chamber 213 is conveyed to the first end of the development chamber 213, it falls into the stirring chamber 214 through a passage 212 between the development chamber 213 and stirring chamber 214. That is, the developer in the development chamber 213 is conveyed by the first conveyance screw 205 in one direction in parallel to the axial line of the first conveyance screw 205, and falls into the stirring chamber 214 through the passage 212, and the developer in the stirring chamber 214 is conveyed by the second conveyance screw 206 in the other direction in parallel to the axial line of the second conveyance screw 206, and is pushed up into the development chamber 213 through the passage 212. Thus, the developer circulation path is formed as indicated by an arrow mark in FIG. 3.

On the upstream side of the stirring chamber 214, in terms of the developer conveyance direction, a replenishment developer entrance 209 is provided, which is in connection to the toner reservoir 20. In the stirring chamber 214, a fresh supply of toner from the toner reservoir 20, and the preexisting developer in the stirring chamber 214, are conveyed while being stirred. Consequently, the developer in the stirring chamber 214 becomes uniform in toner density. After being conveyed, while being stirred, in the stirring chamber 214, the developer is conveyed into the development chamber 213, in which it is borne and conveyed by the development sleeve 208. There is a stationary magnet in the hollow of the development sleeve 208. Thus, the developer is made to be borne by the development sleeve 208, by the magnetic field generated by the stationary magnet. Then, as the development sleeve 208 is rotated around the magnet, the developer on the development sleeve 208 is conveyed to the development area where the developer on the development sleeve 208 opposes the peripheral surface of the photosensitive drum 110. Consequently, the electrostatic latent image on the photosensitive drum 110 is developed by the developer on the development sleeve 208.

Also in this embodiment, a fresh supply of toner is trickled into the developing device 200, while the old supply of developer in the developing device 200 is trickled out of the developing device 200. Next, referring to FIG. 4, this process of trickling toner into the developing device 200 while trickling the developer out of the developing device 200 is described. One of the walls of the developer circulation passage (which in this embodiment is one wall of development chamber 213) of the developing device casing 201, is provided with a developer outlet 202, through which the developer in the developing device casing 201 is partially discharged (made to overflow) as the developer is circulated in the casing 201. Thus, the old carrier in the developer in the casing 201 is partially (by preset amount) discharged from the developing device 200. Further, the developing device 200 is continuously replenished with a fresh supply of developer from the toner reservoir 20, by an amount which is proportional to the amount of the toner consumption attributable to image formation, and also, the amount of the carrier discharge through the developer outlet 202. That is, while the developer in the developing device 200 is consumed for image formation, the developing device 200 is continuously replenished with a preset amount of fresh developer, and the old developer in the developing device 200 is discharged from the developing device 200 by the preset amount. Therefore, the deteriorated developer in the developing device 200 is gradually replaced by the fresh supply of toner and the fresh supply of carrier. Therefore, the developer in the developing device 200 is kept stable in quality (freshness) at a preset level. That is, the developer in the developing device remains stable in properties in terms of electrical charge. Therefore, the image forming apparatus 100 is prevented from reducing image quality.

By the way, as the developer is discharged through the developer outlet 202, it is conveyed to the developer recovery section 215, which is under the developing device casing 201. The developer recovery section 215 is made up of a cylindrical conveyance tube, and a conveyance screw, which conveys the developer in the conveyance tube, toward an unshown recovery container, by being rotationally driven by a motor.

As described above, the developing device 200 of the vertical stir type, which is shown in FIGS. 2-4, is structured so that its development chamber 213 and stirring chamber 214 are vertically stacked in parallel. Thus, it has a merit that it is relatively small in the space it occupies in terms of the horizontal direction. Therefore, it makes it possible to reduce in size even a color image forming apparatus of the so-called tandem type, for example, in which multiple developing devices are horizontally aligned. Moreover, it has also the following merit. That is, referring to FIGS. 2 and 3, the developer which was borne by the development sleeve 208, and conveyed to the development area by the development sleeve 208, but, was not consumed for development in the development area, that is, the developer remaining on the developing device 200 after the development, is not recovered in the development chamber 213, by the rotation of the development sleeve 208. Instead, it is recovered by the stirring chamber 214; it is conveyed into the stirring chamber 214. Thus, it is always the developer which has been fully stirred in the stirring chamber 214 that is in the development chamber 213. Therefore, the development sleeve 208 is always supplied with such developer that is uniform in density. Therefore, it is possible to prevent the occurrence of images which suffer from nonuniformity in density in terms of the direction parallel to the axial line of the development sleeve 208, which is attributable to the insufficient stirring of the developer. Therefore, it is possible to obtain images which are uniform in density.

[Developer Outlet]

Next, referring to FIGS. 5-8, the structure of the developer outlet 202 in this embodiment is concretely described. The developing device 200 in this embodiment is usable by the first image forming apparatus, and also, the second image forming apparatus which is different in process speed (image formation speed) from the first image forming apparatus. Thus, it is structured so that it can be switched in the size (cross-section) of the developer outlet 202, as will be described next. By the way, part (a) of FIG. 5 is an external view of the developer outlet 202 of the developing device 200, and its adjacencies. Part (b) of FIG. 5 shows a part of the developing device casing 201, the developer outlet 202, the adjustable plate 203, and the developer outlet cover 204. By the way, part (b) of FIG. 5 shows only a part of the developing device shell 201, developer outlet 202, adjustable plate 203, and developer outlet cover 204.

In this embodiment, the developer outlet 202 is a combination of a rectangular opening 202*a* with which the developer outlet 202 is provided, and the adjustable plate 203 as a means for changing the rectangular opening 202*a* in size. More specifically, a part of the opening 202*a* is covered by the adjustable plate 203. Thus, the portion of the opening 202*a*, which is not covered (blocked) by the adjustable plate 203 functions as the opening of the developer outlet 202, through which a part of the developer in the developing device 200 is discharged.

The developing device 200 is structured so that the adjustable plate 203 can be switched in vertical position (to change the developer outlet opening 202*a* in size) based on whether the developing device 200 is used by the first or second image forming apparatus 100. That is, the adjustable plate 203 is movable relative to the opening 202*a* of the developing device casing 201 to partially cover the developer outlet opening 202*a*. Thus, by changing the adjustable plate 203 in its position relative to the opening 202*a*, it is possible to change the developing device 200 in at least one of its conditions, that is, the size of the opening of its developer outlet 202, and the position of the bottom edge of the opening 202*a*, while the developing device 200 is properly situated in the image forming apparatus 100.

Referring to FIG. 6, in this embodiment, the developing device 200 is structured so that when the developing device 200 is properly situated for image formation, in the image forming apparatus 100, the downstream edge (right edge in FIG. 6) in terms of the developer conveyance direction of the first conveyance screw 205 (FIG. 5) it tilted upward. More concretely, the adjustable plate 203 is provided with a slanted surface 203*a*, which makes up the downstream edge of the developer outlet opening 202*a* in terms of the developer conveyance direction. Thus, the developing device 200 can be changed in both the height (dimension in terms of vertical direction) and width (in terms of horizontal direction) of developer outlet 202, by changing the adjustable plate 203 in position.

The direction in which the slanted surface 203*a* is tilted is the same as the direction in which the blade of the first conveyance screw first conveyance screw 205 is tilted at the inward end of the developer outlet 202. Moreover, the angle θ of the slanted surface 203*a* is made greater than the angle of the blade of the first conveyance screw 205 (Φ can be defined by mathematical equation "tan Φ=external diameter of screw blade/half of screw blade pitch"). By structuring the developer outlet 202 as described above, it is possible to minimize the excessive amount by which the developer is discharged by being flipped up by the rotation of the first conveyance screw 205, without interfering with the process in which the developer in the developing device casing 201 is supposed to be discharged by a preset amount.

In this embodiment, the developing device 200 is structured so that it can be changed in both the size of the developer outlet opening 202*a*, and the position of the bottom edge of the developer outlet opening 202*a*, by vertically moving the adjustable plate 203 having the slanted surface 203*a*, relative to the opening 202*a*. More concretely, referring to part (a) of FIG. 6, when the adjustable plate 203 is in the bottom position (first position), the developer outlet opening 202*a* is largest in size, and also, the bottom edge of the adjustable plate 203 is positioned lowest. On the other hand, when the adjustable plate 203 is in the top position (second position) which is on the top side of the first position, as shown in part (b) of FIG. 6, the developer outlet opening 202*a* is smallest in size, and also, its bottom edge is positioned highest.

Further, in a case where the developing device 200 is used by the first image forming apparatus which is slower in process speed than the second image forming apparatus, the developing device 200 is slower in developer conveyance speed (developer circulation speed) than in a case where the developing device 200 is used by the second image forming apparatus. Therefore, the adjustable plate 203 is placed in the first position. The speed at which the developer is conveyed when the adjustable plate 203 is in the first position is referred to as the "first developer circulation speed". In comparison, in a case where the developing device 200 is used by the second image forming apparatus which is faster in process speed than the first image forming apparatus, the developing device 200 is faster in developer conveyance speed. Therefore, the adjustable plate 203 is placed in the second position shown in part (b) of FIG. 6. The speed at which the developer is conveyed when the adjustable plate 203 is in the second position will be referred to as the "second developer circulation speed".

As described above, in this embodiment, in a case where the developer conveyance speed has to be the first one, the adjustable plate 203 is placed in the first position (low position), whereas in a case where the developer conveyance speed has to be the second one, the adjustable plate 203 is placed in the second position (high position). That is, the developer outlet opening 202*a* can be changed in size (switched in size), by moving upward or downward by an amount E shown in the drawings. By the way, the positions into which the adjustable plate 203 is movable do not need to be two; it may be three or more. That is, the developing device 200 may be structured so that the developer outlet opening 202*a* can be given multiple sizes.

Further, in the case of the developing device 200 in this embodiment, the developer outlet cover 204 is attached to the developing device casing 201 to cover both the adjustable plate 203 and opening 202*a* so that the adjustable plate 203 can be moved within the developer outlet cover 204. The developer outlet cover 204 holds the adjustable plate 203 between itself and developing device casing 201, and allows the adjustable plate 203 to be moved within the developer outlet cover 204. The developer outlet cover 204 keeps the developer outlet 202 entirely covered regardless of the position in which the adjustable plate 203 is. As the developer is discharged from the developer outlet 202, it is conveyed by the developer outlet cover 204 to the developer recovery conveyance section 215.

Further, the adjustable plate 203 is provided with a knob 203*b* which can be used to change the adjustable plate 203 in position, and also, can be bent to prevent the adjustable plate 203 from being changed in position once the adjustable plate 203 is changed in position. Referring to FIG. 7, the knob 203*b* is exposed through a long hole 204*a* with which the developer outlet cover 204 is provided. Thus, as an operator moves the knob 203*b* along the long hole 204*a*, the adjustable plate 203 moves with the knob 203*b*. That is, the developer outlet opening 202*a* can be changed in size, etc., by moving the knob 203*b*. After the knob 203*b* is moved, it is to be bent to prevent it from being changed in position due to operational errors, and/or prevent the developing device 200 from being installed in an image forming apparatus of a wrong type.

The long hole 204*a* is shaped so that when the developing device 200 is properly situated for development in the image forming apparatus, its long edges are parallel to the vertical direction, allowing thereby the adjustable plate 203 to be moved into the above-described first or second position. Thus, even in a case where the knob 203*b* is moved downward, as shown in part (a) of FIG. 7, to place the adjustable plate 203 in the first position, the edges of the long hole 204*a* do not interfere with the knob 203*b*. Further, even in a case where the knob 203*b* is moved upward, as shown in part (b) of FIG. 7, to place the adjustable plate 203 in the second position, the edges of the long hole 204*a* do not interfere with the knob 203*b*. By the way, the developing device 200 may be structured so that as the adjustable plate 203 is moved into the first position, the knob 203*b* comes into contact with the bottom edge of the long hole 204*a*, and as the adjustable plate 203 is moved into the second position, the knob 203*b* comes into contact with the top edge of the long hole 204*a*, in order to prevent the adjustable plate 203 from being moved out of a preset range.

In this embodiment, in order to ensure that the adjustable plate 203 is moved into the first or second position as described above, the developing device 200 is structured as follows. That is, referring to FIG. 8, the inward surface of the developer outlet cover 204, which faces the adjustable plate 203, is provided with a protrusion 301, which is semicircular in cross-section, whereas the outward surface of the adjustable plate 203, which faces the developer outlet cover 204 is provided with multiple (two in this embodiment) grooves 302*a* and 302*b*, in which the protrusion 301 can fit. In terms of the vertical direction, a distance E is provided between the multiple (two) grooves 302*a* and 302*b*. Further, the two grooves 302*a* and 302*b* are V-shaped in cross-section. That is, the lateral walls of each of the grooves 302*a* and 302*b* are slanted relative to the outward surface of the adjustable plate 203 so that the closer to the developer outlet cover 204, the wider the distance between the lateral walls.

The developing device 200 is structured so that when the protrusive portion 301 is in engagement with the top groove 302*a*, the adjustable plate 203 is in the first position, whereas when the protrusive portion 301 is in the bottom groove 302*b*, the adjustable plate 203 is in the second position. As the adjustable plate 203 is moved, the protrusive portion 301 is moved along one of the slanted lateral surfaces of the groove 302*a* or 302*b*, being thereby gradually moved out of the groove. During this movement of the adjustable plate 203, the lateral plate 204*b* of the developer outlet cover 204, to which the protrusive portion 301 belongs, elastically deforms to allow the movement of the protrusive portion 301 (developer outlet cover 204). Then, as the adjustable plate 203 is moved further, the protrusive portion 301 having come out of the groove 302*a* or 302*b* moves from the groove, and engages into the groove 302*b* or groove 302*a*, respectively, ending thereby the movement of the adjustable plate 203.

Since the developing device 200 is structured as described above, not only is it possible to accurately place the adjustable plate 203 in the first or second position, but also, it is possible to ensure that the adjustable plate 203 is securely placed in the intended position, while providing the operator with a "clicking" sound. By the way, instead of providing the adjustable plate 203 and developer outlet cover 204 with the protrusive portion 301 and grooves 302*a* and groove 302*b*, respectively, the adjustable plate 203 and developer outlet cover 204 may be provided with multiple (two) grooves and a protrusive portion, respectively. The effects of this structural arrangement are the same as those in this embodiment. Moreover, in a case it is wanted to place the adjustable plate 203 in one of three or more positions, the developer outlet cover 204 is to be provided with three or more grooves.

In this embodiment, the developing device 200 is structured so that the adjustable plate 203 can be moved to change the developing device 200 in the size of the developer outlet opening 202*a*, and also, in the position of the bottom edge of the opening 202*a*, depending on whether the developing device 200 is used for the first or second image forming apparatus. More concretely, in a case where the developing device 200 is to be used for the first image forming apparatus which has the first developer circulation speed (slower in process speed), the adjustable plate 203 is placed in the first position (low position) to increase the developer outlet opening 202*a* in size, and also, to lower the bottom edge of the developer outlet opening 202*a*. As the developing device 200 is reduced in developer circulation speed, it becomes lower in the position of the apparent top surface of the body of the developer therein, and therefore, it is more difficult for the developer in the developing device 200 to be discharged. Therefore, the adjustable plate 203 is placed in the first position to make the developing device 200 proper in the amount by which the developer is to be discharged from the developing device 200.

On the other hand, in a case where the developing device 200 is used for the second image forming apparatus 100 which has the second developer circulation speed (faster in process speed), the adjustable plate 203 is placed in the second position (high position) to reduce the developer outlet opening 202*a* in size, and also, to raise the bottom edge of the developer outlet opening 202*a*. As the developing device 200 is increased in developer circulation speed, it becomes higher in the position of the apparent top surface of the body of the developer therein, and therefore, it is easier for the developer in the developing device 200 to be discharged. Therefore, the adjustable plate 203 is placed in the second position to make the developing device 200 proper in the amount by which the developer is discharged from the 200.

In this embodiment, the developing device 200 is changed (switched) in the condition of the developer outlet 202 by moving the adjustable plate 203 as described above. Therefore, the developer outlet 202 does not need to be provided with two separate driving systems. Thus, it is possible to realize the developing device (developing device 200) which can be used by multiple image forming apparatuses which are different in process speed, and yet, is lower in cost than any of conventional developing device which can be used by multiple image forming apparatuses different in process speed. As explained previously, providing a developing device with a driving system for driving a development sleeve, and a driving system for driving a developer conveying member, to make it possible to change only the development sleeve in rotational speed according to the process speed of the image forming apparatus, increases the developing device in cost. In comparison, in this embodiment, the developing device 200 can be changed (switched) in the condition of the developer outlet 202 according to the specification (process speed) of the image forming apparatus which employs the developing device 200, to match the performance of the developing device 200 in terms of developer discharge, to that of the apparatus. That is, it does not need to be changed only in the rotational speed of the development sleeve according to the process speed of the image forming apparatus, and therefore, it does not need to be provided with two independent driving systems, that is, the system for driving the driving sleeve, and system for driving the developer conveying member. Further, the adjustable plate 203 is manually moved by an operator. Therefore, the developing device 200 does not need to be provided with a system dedicated to moving the adjustable plate 203. That is, this embodiment can provide a developing device which is useable by multiple image forming apparatuses which are different in process speed, and yet, is substantially lower in cost than any conventional developing device usable by multiple image forming apparatuses which are different in process speed.

Moreover, this embodiment is meritorious in that it makes it possible to reduce a developing device in cost by mass-producing it by a greater number, and also, to eliminate the problem that multiple components which are similar in specifications have be manufactured (therefore, not only is developing device factory increased in productivity, but also, reduced in assembly errors). Further, since the same developing devices can be used by multiple image forming apparatuses different in process speed, it is possible to reduce the number by which developing devices have to be manufactured to be stocked in factories and warehouses.

Next, referring to FIG. 9, the test conducted to confirm the effects of this embodiment is described. In this test, the relationship between the amount of the developer in the developing device 200, and the amount by which the developer was discharged from the developing device 200, was investigated, with the developer circulation speed set to the first (slow) and second (fast) developer circulation speeds, and also, the adjustable plate 203 placed in the first (low) and second (high) positions. More specifically, the first and second developer circulation speeds were made to correspond to the process speeds 350 mm/sec and 450 mm/sec of the first and second image forming apparatuses, respectively. Further, the aforementioned distance E, by which the adjustable plate 203 is to be moved was set to 2.5 mm.

A solid line α in FIG. 9 represents a case in which the adjustable plate 203 was in the first position (low position) and the developer was circulated at the first developer circulation speed (slow speed). In this case, the developer in the developing device 200 was not discharged through the developer outlet 202 until the amount of the developer in the developing device 200 reached 550 g. Thereafter, the amount by which the developer was discharged per unit length of time from the developer outlet 202 was increased by the subsequent replenishment of the developing device 200 with developer.

A broken line β in FIG. 9 represents a case where the adjustable plate cover 203 was in the second position (high position) and the developer was circulated at the first developer circulation speed. In this case, the amount of the developer in the developer outlet 202 increased. The proper amount for the developer in the developing device 200 is roughly 550 g, regardless of the developer circulation speed. Therefore, it is evident that in a case where the adjustable plate cover 203 is placed in the second position, and the developer is circulated at the first developer circulation speed, the amount of the developer in the developing device 200 exceeds the proper range.

On the other hand, a single-dot chain line γ in FIG. 9 represents a case where the adjustable plate 203 was placed in the second position, and the developer was circulated at the second developer circulation speed (faster speed). The line γ virtually coincides with the solid line α which represents the case where the adjustable plate 203 was place in the first position and the developer was circulated at the first developer circulation speed. That is, in this case, it was possible to keep the developing device 200 stable in the amount of the developer therein at a preset (desired) level, whether the developer circulation speed was kept at the first or second one.

By the way, in a case where one type of developing device is used for multiple image forming apparatuses which are different in process speed, it occurs that once the developing device is set in the condition of its developer outlet 202, according to the type of the toner used by the apparatus, it becomes impossible for the developing device to be used for an image forming apparatus of another type. Therefore, once the knob **203*b* is placed in the position which corresponds to the developer circulation speed of an image forming apparatus, the knob 203*b* is to be bent to prevent the developing device from being changed in the condition of its developer outlet 202. Thus, even if an attempt is made to change the developing device in the condition of the developer outlet 202** to use the developing device for an image forming apparatus of another type (different in process speed), the developing device cannot be used for an image forming apparatus of another type which is different in process speed. That is, it is possible to prevent the developing device from use by an image forming which is different in process speed.

Further, it is possible that some operators will make errors when the operators are setting a developing device in the condition of the developer outlet 202, for a given image forming apparatus, and/or will install a developing device, the condition of its developer outlet 202 has been set for a given image forming apparatus, into another image forming apparatus which is different in process speed from the given apparatus, without changing the developing device in the condition of the developer outlet 202. That is, it is possible that a developing device will be installed in a wrong image forming apparatus. As for means for preventing installation errors such as the above-described ones, it is possible to structure a developing device as follows.

More concretely, referring to part (a) of FIG. 10, one of the walls of the developing device chamber in the main assembly of an image forming apparatus is provided with a sensor 311, which is a detecting means for detecting whether or not the condition of the developer outlet 202 agrees with the process speed of the image forming apparatus into which the developing device 200 is being installed. The sensor 311 is an image sensor or the like. It is for detecting the state (position, for example) of a knob 312, such as the above-described knob 203*b* for changing (switching) a developing device in the condition of the developer outlet 202. In a case where the developing device 200 is structured as described above, as the developing device 200 is inserted into the developing device chamber 310, the position of the knob 312 is detected by the sensor 311. If the knob 312 is not in a desired position, an operator is informed of the error by a specific sound and/or through an unshown control panel or the like. Thus, it is possible to prevent the developing device 200 from being installed in a wrong image forming apparatus.

Further, the structure for preventing the developing device installation error such as the above-described one may be as shown in part (b) of FIG. 10. That is, the developing device 200 is provided with a knob 313 such as knob 203*b* which protrudes from a developing device casing 201, and which can be switched in position to change the developing device 200 in the condition of the developer outlet 202. Further, one of the walls 310A of the developing device chamber of an image forming apparatus is provided with a groove 314 through which the knob 313 is moved only when the condition of the developer outlet 202 agrees with the process speed of the image forming apparatus. Therefore, unless the knob 313 is in a desired position, it cannot move through the groove 314, preventing thereby the developing device 200 from being installed into the developing device chamber of a wrong image forming apparatus. In other words, it is possible to prevent the above-described developing device installation error.

Further, referring to part (c) of FIG. 10, in this case, the entrance of the groove 314 may be provided with a guiding surface 315. In a case where the knob 313 is in the position which makes the condition of the developer outlet 202 disagree with the process speed of the image forming apparatus, it comes into contact with the guiding surface 315, and is guided by the guiding surface 315 to the position which makes the condition of the developer outlet 202 agree with the process speed of the image forming apparatus. Therefore, even if the knob 313 is not in a desired position, as the developing device 200 is inserted into the developing device chamber, the knob 313 is automatically guided into the desired position to make the condition of the developer outlet 202 match the process speed of the image forming apparatus.

Moreover, the first and second image forming apparatuses may be the same one, which is structured so that its knob 313 can be placed in the first position which agrees with the first process speed (of first image forming apparatus), or the second position which agrees with the second process speed (second image forming apparatus) to change the developing device 200 in the condition of the developer outlet 202, by changing the values set in a firmware, for example. That is, the developing device 200 may be structured as shown in FIG. 11, for example.

In the case of the developing device 200 shown in FIG. 11, the knob appendage 313 can be placed in the first position which corresponds to the process speed of the first image forming apparatus, or the second position which corresponds to the process speed of the second image forming apparatus. The condition of the developer outlet 202 is changed (switched) by changing (switching) the knob 313 in position. In the case of the developing device 200 shown in FIG. 11, the bottom position is the first position, and the top position is the second position. A developing device chamber 310B has a guiding device 316 as a guiding means which can be changed (switched) in attitude between the first and second guiding attitudes. When it is in the first guiding attitude, it guides the knob 313 to the second position by engaging with the knob 313 which is in the first position. When it is in the second attitude, it guides the knob 313 to the first position by engaging with the knob 313 which is in the second position.

To describe more concretely, the guiding device 316 has a pivotally movable member 318 which is pivotally supported by a shaft 317 with which the developing device chamber 310B is provided. The pivotally movable member 318 has a protrusive portion 319 which is moved into the first or second guiding position, by the pivoting of the pivotally movable member 318. The protrusive portion 319 protrudes from the main section of the pivotally movably member 318 in the opposite direction of the direction in which the developing device 200 is installed into the image forming apparatus. In terms of the pivoting direction of the pivotally movably member 318, the top and bottom surfaces of the protrusive portion 319 make up the first and second engaging portions 320*a* and 320*b*. Further, the pivotally movably member 318 has first and second holding portions 321*a* and 321*b*, which are on its top and bottom sides, and are at the base portions of the protrusive portion 319. In the case of the developing device 200 shown in FIG. 11, the position in which the protrusive portion 319 is after the counterclockwise pivoting of the pivotally movably member 318 is the first guiding position of the protrusive portion 319, and the position in which the protrusive portion 319 is after the clockwise pivoting of the 381 is the second guiding position of the protrusive portion 319.

The end portion of the protrusive portion 319 is shaped so that the closer to the tip, the smaller the distance between its upstream and downstream surfaces, in terms of the counterclockwise rotation of the pivotally movably member 318. The upstream and downstream surfaces are the first and second engaging portions 320*a* and 320*b*, respectively. The developing device 200 is structured so that when the protrusive portion 319 is in the first guiding position in which it is after the downward pivoting of the pivotally movably member 318, the first engaging portion 320*a*, which is the top surface of the protrusive portion 319, tilts upward toward the base portion of the 310, as shown in part (a) of FIG. 11, and also, so that when the protrusive portion 319 is in the second guiding position in which it is after the upward pivoting of the pivotally movably member 318, the second engaging portion 320*b* which is a part of the bottom surface of the protrusive portion 319 tilts downward toward the tip of the protrusive portion 319 as shown in part (b) of FIG. 11.

On the other hand, the base portion of the protrusive portion 319 is shaped so that the closer to the base, the narrower the distance between its top and bottom surfaces in terms of the pivotal direction of the pivotally movably member 318. The base portion of the top surface of the protrusive portion 319 is the first holding portion 321*a*, and the base portion of the bottom surface of the protrusive portion 319 is the second holding portion 321*b*. Further, the developing device 200 is structured so that when the protrusive portion 319 is in the first guiding position in which it is after the downward rotation of the pivotally movably member 318, the first holding portion 321*a*, which is a part of the bottom surface of the protrusive portion 319, is roughly horizontal, as shown in part (a) of FIG. 11, whereas when the protrusive portion 319 is in the second guiding position in which it is after the upward pivoting of the pivotally movably member 318, the second holding portion 321*b*, which is a part of the bottom surface of the protrusive portion 319, is roughly horizontal.

When the protrusive portion 319 structured as described is in its first guiding position, it engages with the knob 313 by its first engaging portion 320*a*, and guides the knob 313 by the first engaging portion 320*a*, whereas when it is in its second guiding position, it engages with the knob 313 by its second engaging portion 320*b*, and guides the knob 313 by the second engaging portion 320*b*. To describe concretely with reference to drawings, it is assumed here that the image forming apparatus into which the developing device 200 is installed is used with the knob 313 placed in the second position. Therefore, the guiding device 316 guides the protrusive portion 319 into the first guiding position in which it will be after the downward pivoting of the pivotally movably member 318, as shown in part (a) of FIG. 11. Thus, the developing device 200 is inserted into the image forming apparatus in the direction indicated by an arrow mark (rightward in drawing), with the knob 313 being in the first position (bottom position), as shown in part (a) of FIG. 11. Next, referring to part (b) of FIG. 11, during this insertion of the developing device 200, the knob 313 which is in its first position comes into contact with the first engaging portion 320*a* of the protrusive portion 319, and is guided by the engaging portion 320*a*. Thus, as the developing device 200 is inserted further into the image forming apparatus, the knob 313 is guided upward, until it reaches the first holding portion 321*a*, as shown in part (c) of FIG. 11, ending the insertion of the developing device 200 into the image forming apparatus, and the knob 313 held by the first holding portion 321*a* remains in its second position.

As described above, even if the knob 313 which is to be in its second position is in the first position, the knob 313 is guided to the second position by the guiding device 316, because the guiding device 316 has been switched in position to the first guiding position. Therefore, it is possible to prevent one of developing device installation errors.

By the way, it sometimes occurs that an image forming apparatus into which the developing device 200 is installed is used with the knob 313 being in the first position. In such a case, the guiding device 316 places the protrusive portion 319 in the second guiding position, in which the protrusive portion 319 is after the upward pivoting of the pivotally movably member 318, as shown in part (d) of FIG. 11. Thus, even if the knob 313 is in the second position, the knob 313 is guided to the first holding portion 321*b*, being thereby placed in the first position, by the second engaging portion 320*b*, as in the above-described case. Therefore, it is possible to prevent the installation error.

As for the changing of the pivotally movable member 318 in attitude, it is to be done when an image forming apparatus is shipped out of a factory, a warehouse, or the like, or during the initial setup of the apparatus, in order to prevent the developing device installation error from occurring during the subsequent developing device replacement. By the way, an image forming apparatus may be structured so that the attitude of the pivotally movably member 318 of the guiding device 316 is to be manually changed, or by a solenoid 322 as a driving means shown in part (a) of FIG. 11. That is, an image forming apparatus may be structured so that the protrusive portion 319 can be changed in position by turning on or off the electrical power supply to the solenoid 322.

If an image forming apparatus is structured so that the guiding device 316 can be changed in the position of the protrusive portion 319 by the solenoid 322, the guiding device 316 can be automatically changed in the position of the protrusive portion 319 according to a value set for a firmware. By the way, the guiding device 316 may be driven by other driving means than a solenoid. That is, it may be driven by a motor, for example.

Embodiment 2

Next, referring to FIG. 12, the second embodiment of the present invention is described. In the above-described first embodiment, the adjustable plate 203 is provided with the slanted surface 203*a* to change the developer outlet opening 202*a* in size, and the position of the bottom edge of the opening 202*a*. In this embodiment, however, an adjustable plate 203A is not provided with a slanted surface. Therefore, the developer outlet opening 202*a* is rectangular. Also in this embodiment, the developing device 200 is structured so that the developer outlet opening 202*a* can be changed in both size, and the position of its bottom edge, by vertically moving the adjustable plate 203A. Otherwise, the developing device 200 in this embodiment is the same in structure and function as the one in the first embodiment.

Embodiment 3

Next, referring to FIG. 13, the third embodiment of the present invention is described. In the above-described first and second embodiments, the developer outlet opening 202*a* was changed in both size, and the position of its bottom edge, by vertically moving the adjustable plates 203 and 203A, respectively. In comparison, in this embodiment, an adjustable plate 203B is moved in the left-right direction which is parallel to the top and bottom edges of the opening 202*a* which is rectangular. In the case of a developing device such as the one in this embodiment, it is structured so that the movement of the adjustable plate 203B does not change its developer outlet opening 202*a* in the position of its top and bottom edges, but, it changes the developer outlet opening 202*a* in size. Therefore, the developer outlet cover 204 (FIGS. 5 and 7) is shaped so that its long edges are parallel to the lengthwise direction of the rectangular hole. In this embodiment, even in a case where the direction in which the adjustable plate 203B is moveable is limited to the left-right direction due to the structure, or the like, of the developing device 200, the developing device 200 can be changed in the condition of the developer outlet 202. Also in this embodiment, the developer outlet opening 202*a* is rectangular. Otherwise, the developing device 200 in this embodiment is the same in structure and function as the one in the first embodiment.

Miscellanies

In the above-described embodiments of the present invention, the developing device 200 was changed in the condition of its developer outlet by moving the adjustable plate which partially covers the opening 202*a* of the developing device casing 201. However, the developing device 200 may be structured so that its component for covering the entirety of the opening 202*a* may be provided with an opening, and the developing device 200 can be changed in the condition of the developer outlet 202 by moving this component. In this case, the opening of this component is the developer outlet. Further, this opening may be shaped like the developer outlet opening 202*a* in the first embodiment. Further, the developing device 200 may be structured so that the opening 202*a* itself is shaped like the developer outlet opening 202*a* in the first embodiment, and the effects such as those in the first embodiment can be obtained by moving a cover such as those in the first and second embodiments, which do not have a slanted surface. The direction in which the cover is moved does not need to be limited to the vertical or horizontal direction. It may be a direction which is angled relative to the vertical direction. Moreover, the attributes in which the developer outlet 202 is changed may be only the size of its opening or the position of the bottom edge of the opening 202*a*. That is, in a case where the developing device 200 is used by an image forming apparatus which is faster in developer circulation speed, it can be made proper in the amount by which the developer is discharged through the developer outlet 202, by reducing the developer outlet opening 202*a* in size, or moving adjustable plate 203 upward to position the bottom edge of the developer outlet opening 202*a* higher. By the way, whether the developing device 200 is to be changed in one or both of the above-described attributes is optional. It has only to be determined according to the properties of the developing device 200. According to the present invention, a developing device is provided with a means which is capable of changing in size, the opening of the developer outlet of the device, and/or the position of the bottom edge of the opening, based on whether the developing device is used in the first or second image forming apparatus, as the developing device is inserted into an image forming apparatus. Therefore, a developing device does not need to be provided with both a system for driving the development sleeve, and a system for driving the developer conveying member. Therefore, it is possible to provide a developing device which can be employed multiple image forming apparatuses which are different in process speed, and yet, is significantly lower in cost than any conventional developing device which can be employed multiple image forming apparatuses which are different in process speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2014-194938 filed on Sep. 25, 2014 and 2015-135315 filed on Jul. 6, 2015, which are hereby incorporated by reference herein in their entirety.

What is claimed is:

1. A developing device selectively mountable to one of a plurality of image forming apparatuses including a first image forming apparatus for forming an image at a first image forming speed and a second image forming apparatus for forming an image at second image forming speed, said developing device comprising:

a rotatable developer bearing member configured to develop an electrostatic latent image formed on an image bearing member;

a developer container configured to accommodate a developer;

a feeding member configured to feed the developer in said developer container;

a discharge opening provided in said developer container and configured to permit discharging of the developer from said developer container;

a covering portion movable relative to said developer container and capable of changing a level of a lower end of said discharge opening depending on the image forming apparatus to which said developing device is mounted;

a first positioning portion configured to engaged with said covering portion to determine a position of said covering portion such that the lower end of said discharge opening is at a first level; and a second positioning portion configured to engage with said covering portion to determine the position of said covering portion such that the lower end of said discharge opening is at a second level which is different from the first level.

2. A device according to claim 1, wherein a position of the lower end of said discharge opening in a state that said developing device is mounted to said image forming apparatus is at a higher level in a downstream side with respect to a feeding direction of said feeding member than in an upstream side.

3. A device according to claim 1, wherein the first level and the second level are provided by changing a ratio of coverage of said discharge opening by said covering portion.

4. A device according to claim 1, further comprising a cover configured to cooperate with said developer container to nip said covering portion, wherein a projection is provided on one of opposing surfaces of said covering portion and said cover, and a groove engageable with said projection is provided on the other of said opposing surfaces of said covering portion and said cover.

5. A device according to claim 1, further comprising an operating portion provided on said covering portion, said operating portion being operable to change the position of said covering portion.

6. A device according to claim 1, wherein the first image forming speed is lower than the second image forming speed, and in a state that said developing device is mounted in the first image forming apparatus, the lower end of said discharge opening is set at the first level, and in a state that said developing device is mounted in the second image forming apparatus, the lower end of said discharge opening is set at the second level, and wherein the first level is lower than the second level.

7. A developing device, selectively mountable to one of a plurality of image forming apparatuses including a first image forming apparatus for forming an image at a first image forming speed and a second image forming apparatus for forming an image at a second image forming speed, said developing device comprising:

a rotatable developer bearing member configured to develop an electrostatic latent image formed on an image bearing member;

a developer container configured to accommodate a developer;

a feeding member configured to feed the developer in said developer container;

a discharge opening provided in said developer container and configured to permit discharging of the developer from said developer container;

a covering portion movable relative to said developer container and capable of changing an area of said discharge opening depending on the image forming apparatus to which said developing device is mounted;

a first positioning portion configured to engage with said covering portion to determine a position of said covering portion such that the area of said discharge opening is a first area of said discharge opening; and a second positioning portion configured to engage with said covering portion to determine the position of said covering portion such that the area of said discharge opening is a second area of said discharge opening, which is different from the first area.

8. A device according to claim 7, wherein a position of a lower end of said discharge opening in a state that said developing device is mounted to said image forming apparatus is at a higher level in a downstream side with respect to a feeding direction of said feeding member than in an upstream side.

9. A device according to claim 7, wherein the area of said discharge opening is capable of being changed by changing the ratio of coverage of said discharge opening by said covering portion.

10. A device according to claim 7, further comprising a cover configured to cooperate with said developer container to nip said covering portion, wherein a projection is provided on one of opposing surfaces of said covering portion and said cover, and a groove engageable with said projection is provided on the other of said opposing surfaces of said covering portion and said cover.

11. A device according to claim 7, further comprising an operating portion provided on said covering portion, said operating portion being operable to change the position of said covering portion.

12. A device according to claim 7, wherein the first image forming speed is lower than the second image forming speed, and in a state that said developing device is mounted in said first image forming apparatus, the area of said discharge opening is set in the first area, and in a state that said developing device is mounted in the second image forming apparatus, the area of said discharge opening is set in the second area, and wherein the first area is larger than the second area.

13. A developing device comprising:

a rotatable developer bearing member configured to develop an electrostatic latent image formed on an image bearing member;

a developer container configured to accommodate a developer;

a feeding member configured to feed the developer in said developing container;

a discharge opening provided in said developer container and configured to permit discharging of the developer from said developer container;

a covering portion movable relative to said developer container and capable of changing a level of a lower end of said discharge opening;

a first positioning portion configured to engage with said covering portion to determine a position of said covering portion such that the lower end of said discharge opening is at a first level; and a second positioning portion configured to engage with said covering portion to determine the position of said covering portion such that the lower end of said discharge opening is at a second level which is different from the first level.

14. A device according to claim 13, wherein a position of the lower end of said discharge opening is at a higher level in a downstream side with respect to a feeding direction of said feeding member than in an upstream side.

15. A device according to claim 13, wherein the first level and the second level are provided by changing a ratio of coverage of said discharge opening by said covering portion.

16. A device according to claim 13, further comprising a cover configured to cooperate with said developer container to nip said covering portion, wherein a projection is provided on one of opposing surfaces of said covering portion and said cover, and a groove engageable with said projection is provided on the other of opposing surfaces of said covering portion and said cover.

17. A device according to claim 13, further comprising an operating portion provided on said covering portion, said operating portion being operable to change the position of said covering portion.

18. A developing device comprising:

a rotatable developer bearing member configured to develop an electrostatic latent image formed on an image bearing member;

a developer container configured to accommodate a developer;

a feeding member configured to feed the developer in said developing container;

a discharge opening provided in said developer container and configured to permit discharging of the developer from said developer container;

a covering portion movable relative to said developer container and capable of changing an area of said discharge opening;

a first positioning portion configured to engage with said covering portion to determine a position of said covering portion such that the area of said discharge opening is a first area of said discharge opening; and a second positioning portion configured to engage with said covering portion to determine the position of said covering portion such that the area of said discharge opening is a second area of said discharge opening which is different from the first area.

19. A device according to claim 18, wherein a position of a lower end of said discharge opening is at a higher level in a downstream side with respect to a feeding direction of said feeding member than in an upstream side.

20. A device according to claim 18, wherein the area of said discharge opening is capable of being changed by changing the ratio of coverage of said discharge opening by said covering portion.

21. A device according to claim 18, further comprising a cover configured to cooperate with said developer container to nip said covering portion, wherein a projection is provided on one of opposing surfaces of said covering portion and said cover, and a groove engageable with said projection is provided on the other of opposing surfaces of said covering portion and said cover.

22. A device according to claim 18, further comprising an operating portion provided on said covering portion, said operating portion being operable to change the position of said covering portion.

23. A developing device comprising:

a rotatable developer bearing member configured to develop an electrostatic latent image formed on an image bearing member;

a developer container configured to accommodate a developer;

a feeding member configured to feed the developer in said developing container;

a discharge opening provided in said developer container and configured to permit discharging of the developer from said developer container;

a covering portion movable relative to said developer container and capable of changing a level of a lower end of said discharge opening; and a guiding portion provided with a guiding groove engaged with a projection provided on said covering portion to guide said covering portion along said guiding groove from a first position to a second position;

wherein the level of a lower end of said discharge opening when said covering portion is in the second position is different from the level of the lower end of said discharge opening when said covering portion is in the first position, and wherein said covering portion is provided with a grip portion configured to grip said covering portion when said covering portion is moved from the first position to the second position along said guiding groove in a state that said projection is engaged with said guiding groove.

24. A device according to claim 23, wherein a position of the lower end of said discharge opening is at a higher level in a downstream side with respect to a feeding direction of said feeding member than in an upstream side.

25. A device according to claim 23, wherein the level of the lower end of said discharge opening is provided by changing a ratio of coverage of said discharge opening by said covering portion.

26. A device according to claim 23, further comprising a cover configured to cooperate with said developer container to nip said covering portion, wherein said guide portion is provided on said cover; and a projection is provided on one of opposing surfaces of said covering portion and said cover, and a groove engageable with said projection is provided on the other of opposing surfaces of said covering portion and said cover.

27. A developing device comprising:

a rotatable developer bearing member configured to develop an electrostatic latent image formed on an image bearing member;

a developer container configured to accommodate a developer;

a feeding member configured to feed the developer in said developing container;

a discharge opening provided in said developer container and configured to permit discharging of the developer from said developer container;

a covering portion movable relative to said developer container and capable of changing an area of said discharge opening; and a guiding portion provided with a guiding groove engaged with a projection provided on said covering portion to guide said covering portion along said guiding groove from a first position to a second position;

wherein the area of said discharge opening when said covering portion is in the second position is different from the area of said discharge opening when said covering portion is in the first position, and wherein said covering portion is provided with a grip portion configured to grip said covering portion when said covering portion is moved from the first position to the second position along said guiding groove in a state that said projection is engaged with said guiding groove.

28. A device according to claim 27, wherein a position of a lower end of said discharge opening is at a higher level in a downstream side with respect to a feeding direction of said feeding member than in an upstream side.

29. A device according to claim 27, wherein the area of said discharge opening is capable of being changed by changing the ratio of coverage of said discharge opening by said covering portion.

30. A device according to claim 27, further comprising a cover configured to cooperate with said developer container to nip said covering portion, wherein said guide portion is provided on said cover;

a projection is provided on one of opposing surfaces of said covering portion and said cover, and a groove engageable with said projection is provided on the other of opposing surfaces of said covering portion and said cover.

31. A developing device comprising:

a rotatable developer bearing member configured to develop an electrostatic latent image formed on an image bearing member;

a developer container configured to accommodate a developer;

a feeding member configured to feed the developer in said developing container;

a discharge opening provided in said developer container and configured to permit discharging of the developer from said developer container;

a movable member movable relative to said developer container from a first position to a second position, wherein the level of a lower end of said discharge opening when said movable member is in the second position is different from the level of the lower end of said discharge opening when said movable member is in the first position; and a grip portion configured to grip said movable member when said movable member is moved relative to said developer container from the first position to the second position.

32. A device according to claim 31, further comprising:

a guiding member provided with a guiding groove engaged with a projection provided on said movable member, said guiding member being capable of guiding movement of said movable member from the first position to the second position relative to said developer container, wherein said movable member is movable along said guiding groove from the first position to the second position relative to said developer container in a state that said projection is in engagement with said guiding groove.

33. A device according to claim 31, wherein said grip portion and said movable member are integrally molded.

34. A device according to claim 31, further comprising a cover mounted on said developer container and capable of holding said movable member at the first position and the second position.

35. A device according to claim 34, wherein one of said movable member and said the cover is provided with a projection, and the other is provided with a first engageable groove engageable with said projection in a state that said movable member is at the first position to fix said movable member at the first position, and a second engageable groove engageable with said projection in a state that said movable member is at the second position to fix said movable member at the second position.

36. A developing device comprising:

a rotatable developer bearing member configured to develop an electrostatic latent image formed on an image bearing member;

a developer container configured to accommodate a developer;

a feeding member configured to feed the developer in said developing container;

a discharge opening provided in said developer container and configured to permit discharging of the developer from said developer container;

a movable member movable relative to said developer container from a first position to a second position, wherein the area of said discharge opening when said movable member is in the second position is different from the area of said discharge opening when said movable member is in the first position; and a grip portion configured to grip said movable member when said movable member is moved relative to said developer container from the first position to the second position.

37. The device according to claim 36, further comprising a guiding member provided with a guiding groove engaged with a projection provided on said movable member, said guiding member being capable of guiding movement of said movable member move from the first position to the second position relative to said developer container, and wherein said movable member is movable along said guiding groove from the first position to the second position relative to said developer container in a state that said projection is in engagement with said guiding groove.

38. A device according to claim 36, wherein said grip portion and said movable member are integrally molded.

39. A device according to claim 36, further comprising a cover mounted on said developer container and capable of holding said movable member at the first position and the second position.

40. A device according to claim 39, wherein one of said movable member and said the cover is provided with a projection, and the other is provided with a first engageable groove engageable with said projection in a state that said movable member is at the first position to fix said movable member at the first position, and a second engageable groove engageable with said projection in a state that said movable member is at the second position to fix said movable member at the second position.

* * * * *